United States Patent [19]

Ngai

[11] Patent Number: 5,051,878

[45] Date of Patent: Sep. 24, 1991

[54] LUMINAIRE HAVING A LENSED REFLECTOR SYSTEM FOR IMPROVED LIGHT DISTRIBUTION CONTROL

[75] Inventor: Peter Y. Y. Ngai, Danville, Calif.

[73] Assignee: Peerless Lighting Corporation, Berkeley, Calif.

[21] Appl. No.: 387,127

[22] Filed: Jul. 28, 1989

Related U.S. Application Data

[63] Continuation-in-part of Ser. No. 260,404, Oct. 20, 1988, abandoned.

[51] Int. Cl.[5] ..... F21V 7/00

[52] U.S. Cl. ..... 362/299; 362/309; 362/327; 362/339; 362/346

[58] Field of Search ..... 362/223, 297, 299, 301, 362/308, 309, 328, 339, 346, 327

[56] References Cited

U.S. PATENT DOCUMENTS

| | | | |
|---|---|---|---|
| 2,326,634 | 8/1943 | Gebhard et al. | 362/328 X |
| 4,510,560 | 4/1985 | Negishi | 362/299 |
| 4,701,831 | 10/1987 | Castelli | 362/299 X |
| 4,799,137 | 1/1989 | Aho | 362/327 X |

*Primary Examiner*—Stephen F. Husar
*Attorney, Agent, or Firm*—Donald L. Beeson

[57] ABSTRACT

A lensed reflector system for a luminaire produces a specular beam of reflected light to provide a degree of directivity to an otherwise non-directive reflector surface. The lensed reflector system is formed by a prismatic lens material, such as a Fresnel lens, overlaying a reflector substrate having, in one aspect of the invention, a diffuse reflecting surface. The combination of the diffuse reflector and prismatic lens, together with the positioning of the reflector system in relation to the luminaire's light source, provides a reflector system which uniquely exhibits both diffuse and specular reflection characteristics depending on the angle at which the reflector system is viewed. The lensed reflector system of the invention can suitably be used in indirect lighting systems employing compact fluorescent lamps for increasing the spread of light from the fixture onto adjacent wall surfaces. The invention also comtemplates a lensed reflector system having a specular reflector substrate wherein a beam of enhanced specular reflectance is produced from an otherwise normally specular reflecting surface.

29 Claims, 2 Drawing Sheets

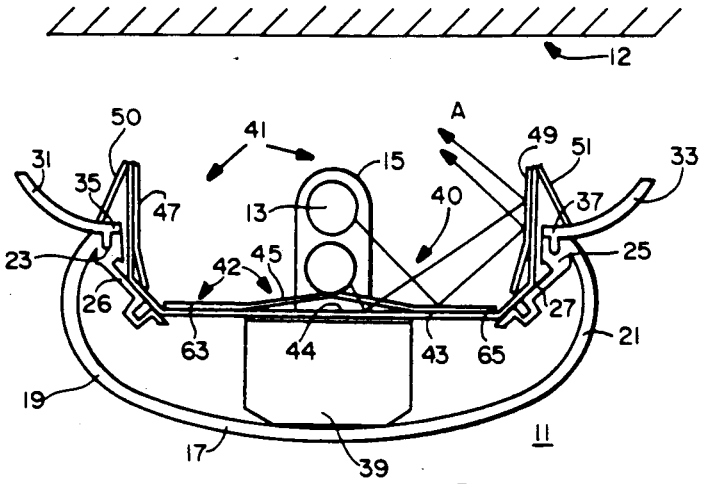
FIG.-1
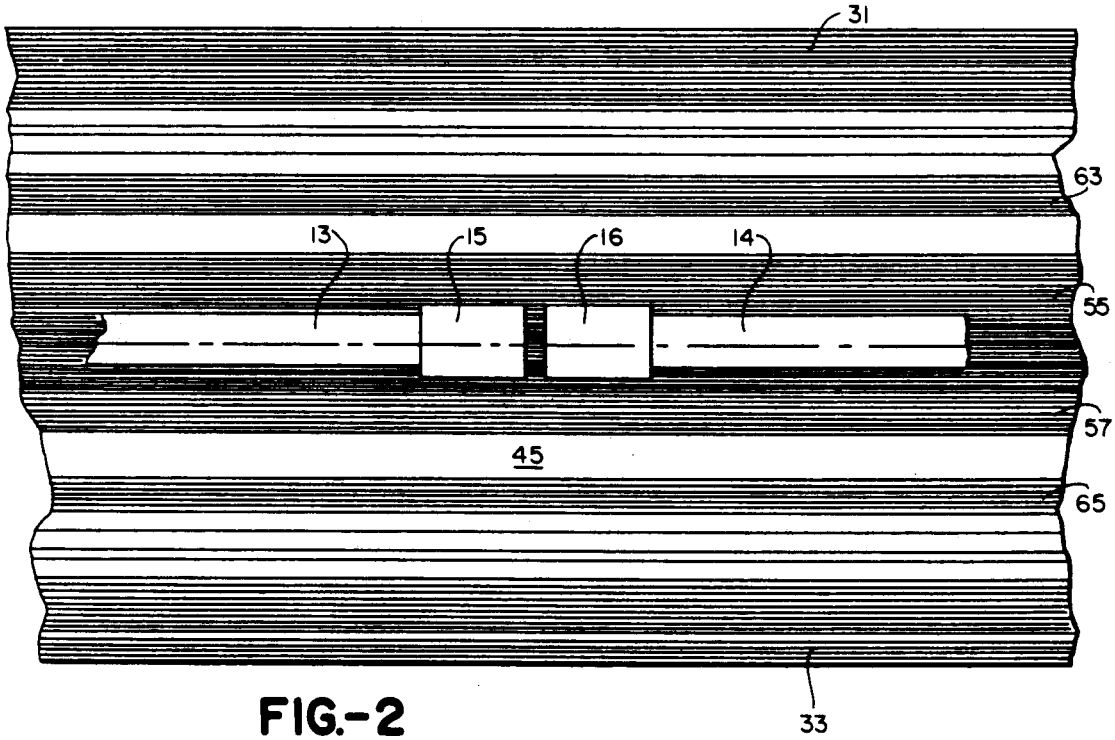
FIG.-2
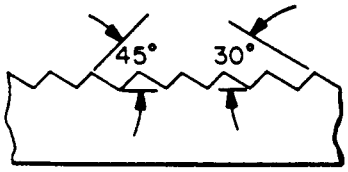
FIG.-3A
FIG.-3
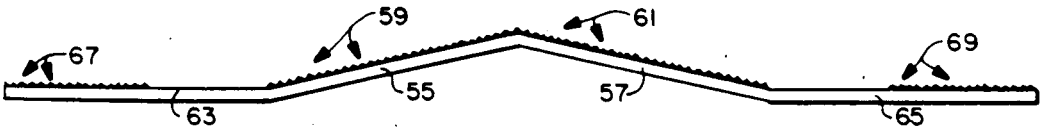

LUMINAIRE HAVING A LENSED REFLECTOR SYSTEM FOR IMPROVED LIGHT DISTRIBUTION CONTROL

CROSS-REFERENCE TO RELATED APPLICATIONS

This is a continuation-in-part of application Ser. No. 07/260,404, filed Oct. 20, 1988.

BACKGROUND OF THE INVENTION

The present invention relates to lighting fixtures generally, and particularly relates to optical systems which control the distribution of light emitted by a fixture. The invention has application in the field of indirect lighting where, for example, widespread distributions of light may be desired for washing overhead and vertical wall surfaces; it also finds application in the field of direct lighting wherein various light distribution patterns may be desired to meet particular lighting requirements.

Different light distribution patterns can be produced from direct or indirect luminaires using combinations of reflectors and or refracting lenses. An optical system might, for example, use a shaped reflector extending over the bottom of the luminaire housing behind the lamps of the luminaire and a refracting lens covering the opening of the housing. The basic goal is to provide an optical system which provides sufficient control over the distribution of light to satisfy the lighting designer's particular lighting needs.

In discussing the problems overcome by the present invention, it is useful to discuss problems that have existed with the optical performance of indirect lighting systems and prior solutions to those problems. As discussed in prior Herst, et al. U.S. Pat. No. 4,667,275, visual comfort in an interior space using indirect lighting systems is normally enhanced if the upper wall and ceiling surfaces which reflect light back into the space are uniformly illuminated. The problem is the difficulty of providing indirect lighting systems, such as systems comprised of a plurality of individual spaced apart luminaires or spaced apart runs of luminaires, with optical systems that are effective in spreading the light away from the luminaire. Without a suitable widespread illumination pattern that washes the wall surfaces over a relatively large area, wall surfaces near the indirect luminaire will exhibit substantial variations in surface brightness, typically showing up as hot spots directly over the luminaires separated by darker areas between luminaires. The resulting brightness contrast ratios on the illuminated walls produce glare that make many visual tasks, such as operating a personal computer or remote terminal having a video display screen, more difficult and fatiguing.

To overcome the visual discomfort associated with uneven light distribution patterns on wall surfaces, indirect luminaires have been devised having optical control systems which push the light from the luminaire's light source in a more lateral direction thereby providing a more effective spread of the light on the walls. Early attempts to increase the light spread involved the use of reflectors in the luminaire housing such as disclosed in Ruud, et al. U.S. Pat. No. 4,065,667. However, such attempts were limited in their efficacy due to inherent limitations of conventional reflector designs: a diffuse reflector that diffused the reflected light evenly in all directions would provide little in the way of directional control and therefor control over the light distribution pattern; on the other hand, specular reflectors, which mirror the image of the light source, would produce undesirable shadows where there was no direct line of sight between the reflector and wall surface. Indeed, specular reflecting surfaces tend to acerbate the problem of hot spots on adjacent wall surfaces by reflecting a virtual image of the light source back onto the these surfaces.

A solution to the limitation of the reflector only optics in indirect luminaires is disclosed in the above-mentioned U.S. Pat. No. 4,667,275, wherein a light control lens is provided over the top opening of the luminaire for refracting portions of the source light of the luminaire in a more lateral direction over the top of the housing side walls. By using the refracting element to effectively bend the source light as it leaves the housing cavity, the designer is able to increase the spread of light from the cavity and overcome the sharp reflected light patterns on the ceiling.

Notwithstanding improvements in optical systems such as disclosed by the U.S. Pat. No. 4,667,275 in connection with indirect lighting systems, the lighting designer is still constrained by his or her ability to control the light coming from within the luminaire cavity. This is particularly true with the recent availability and use of high efficiency, high intensity, compact fluorescent lamps such as the General Electric Biax lamp. Conventional refracting optical systems become less effective as the lighting fixture becomes smaller and more compact because the ability of an optical system to control the light distribution diminishes as the distance between the refracting elements and the light source become smaller. Heretofore, effective control over the distribution of light was not obtainable in a luminaire using an optical element very close to the source.

The present invention overcomes the foregoing limitations on optical control systems for both direct and indirect luminaires by providing a a reflecting optical system which when placed in close proximity to the luminaire's light source enhances the designer's ability to gain control over the directivity and distribution of source light closer to the light source. This can be done to achieve the purposes of the designer, such as increasing the spread of light through the unlensed opening of a luminaire housing or increasing the amount of light directed to other optical elements within the luminaire.

SUMMARY OF THE INVENTION

Briefly, the invention provides in proximity to the luminaire's light source a lensed reflector system, sometimes referred to herein as a "kicker reflector," which exhibits substantially specular reflection characteristics at particular light reflection angles above the system's plane of reflection, and, in one aspect of the invention, substantially diffuse reflection characteristics over the remaining range of its light reflection angles. In other words, it is one aspect of the present invention to uniquely provide a lensed reflector system for a luminaire which is both a specular reflector and a diffuse reflector depending on the angle at which the lensed reflector system is viewed. The light distribution from the lensed reflector system is effectively "kicked" at a particular angle or angles by a highly specular beam of light produced by the system. The light disbursing advantages of diffuse reflectance are retained and combined with the directivity advantages of specular reflectance, giving the designer an increased ability to produce a desired light distribution pattern for a specific application.

In another aspect of the invention the lensed reflector system can have substantially no diffuse reflection component but substantially only specular reflectance. Nonetheless, in this aspect, a beam of specular reflectance is produced at one or more specular reflection angles which are governed by the characteristics of the system's lens.

In all aspects of the invention specular beam characteristics and other normal background reflection characteristics are produced at the same location within the housing from the same optical system rather than from separate locations such as from different side by side reflectors.

The lensed reflector system of the invention is comprised of a front lens portion, closely overlying a reflector substrate. In the first mentioned aspect of the invention the reflector substrate has a substantially diffuse reflecting surface, and in the second mentioned aspect of the invention it has a substantially specular reflecting surface; however, it is also contemplated that a semi-specular or semi-diffuse reflector substrate can be used in particular applications.

At certain angles of reflection, herein called specular beam angles, the internal reflections within the front lens portion of the lensed reflector system will cause the lens portion to dominate the overall system's reflection characteristics. At angles other than these specular beam angles, the reflection characteristics of the system's underlying reflector substrate dominate. The overall characteristics of the resulting lensed reflector system accordingly combine dominant characteristics of each element of the system and permit the lens dominant characteristics to be used to push a greater portion of the available reflected light into particular specular beam of light. Because the lens determines the angle of this reflected beam, the angle of reflection will normally be different than the angle of incidence of the reflected light. One advantage of this will be to give the designer more flexibility in directing light internally within the luminaire, for example, where there is a need to avoid an obstruction in the housing cavity and due to space constraints the reflector element cannot be relocated.

As described in connection with the illustrated embodiments of the invention, it is further contemplated that the front lens portion of the lensed reflector system can be a Fresnel lens which has light concentrating surface prisms. By choosing an appropriate Fresnel lens, and with the lens and underlying substrate reflector suitably positioned in relation to the light source, a specular beam of reflected light can be produced at the reflector plane and from there internally directed within the luminaire housing at a desired angle.

In the diffuse reflector aspect of the invention, the diffuse reflector substrate of the lensed reflector system can suitably be a white diffuse reflector. By providing a reflector substrate with a suitable light diffusing surface, the reflector will not mirror the brightness of the lamps other than at specular beam angles. Thus, the problems associated with specular reflectance, namely bright and dark spots on adjacent wall surfaces, can be avoided. The reflector system will in effect be both a highly specular and highly diffuse reflector.

As above-mentioned, the present invention will have application in relatively compact indirect lighting systems where uniform overhead light distribution patterns are normally highly desirable. However, it will be understood that the invention is not intended to be limited to indirect lighting systems, and can find application in direct or direct-indirect lighting systems, particularly where high intensity compact fluorescent or the like are used.

It is therefore a primary object of the present invention to provide optical means in a luminaire for enhancing the ability of an optical system to control a luminaire's light distribution pattern internally of the luminaire. It is a further object of the invention to provide lighting fixture designers greater control of the distribution of light within the luminaire closer to the luminaire's light source. It is yet another object of the invention to provide an effective optical system for a luminaire employing high intensity compact fluorescent light sources such as Biax lamps. It is still another object of the present invention to provide a light reflecting system that can effectively modify the light distribution characteristics of reflected light at the plane of reflection. It is yet a further object of the invention to provide a reflecting system which can produce both a specular beam of reflectance and diffuse reflectance at the same reflector location. Other objects of the invention will become apparent from the following specification and claims.

DESCRIPTION OF THE DRAWINGS

FIG. 1 is a cross-sectional view of a lensed indirect luminaire employing a kicker reflector in accordance with the invention;

FIG. 2 is a partial top plan view thereof;

FIG. 3 is an end elevational view of the kicker reflector employed in the luminaire illustrated in FIGS. 1 and 2;

FIG. 3A is an expanded, cutaway view of the front lens portion of the kicker reflector shown in FIG. 3 illustrating the prismatic design thereof;

DETAILED DESCRIPTION OF THE ILLUSTRATED EMBODIMENT

Figure 4:
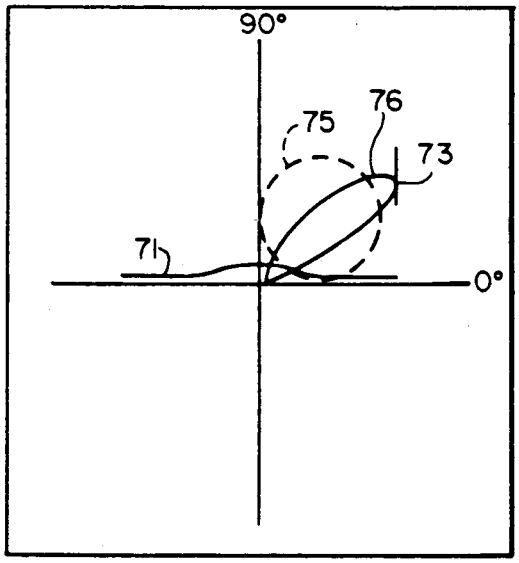
FIG. 4 is a polar graph generally illustrating the effect of the kicker reflector on the overall candle power distribution from an indirect luminaire.

Referring now to the drawings, and specifically to the embodiment of the invention illustrated in FIGS. 1–2, an indirect luminaire 11 has a light source in the form of compact U-shaped high intensity fluorescent lamps 13, 14 (such as Biax lamps sold by the General Electric Company) removably mounted in lamp sockets 15, 16 suitably spaced along the length of the luminaire. The lamp sockets are mounted in an elongated opaque housing 17 having opposite upwardly extending side walls 19, 21, on the top of which are formed lens mounting rims 23, 25 and inwardly extending reflector supports 26, 27. The elongated lens elements 31, 33 are mounted to the housing side walls by securing the base 35, 37 of the lenses to the support rims 23, 25. As best illustrated in FIG. 1, the lens elements extend laterally outwardly and upward in an arcuate shape away from the top of the housing so as to generally face the overhead ceiling surface 12. The overhead ceiling surface below which the luminaire is positioned will thus act as a secondary source of light for illuminating the laterally extending lenses 31, 33 and inducing low brightness therein which is seen by persons in the vicinity of the luminaire. The psychological advantages of such low brightness lens elements are described in Herst, et al. U.S. Pat. No. 4,390,930.

The luminaire housing 17 holds a ballast 39 and necessary electrical wiring (not shown) for electrifying the lamp sockets 15, 16. The top opening 41 generally defined at the top of the housing cavity 40 permits light from the lamps 13, 14 to emerge from the luminaire in an overhead light distribution pattern which illuminates the overhead ceiling surface 12 and any upper vertical wall surfaces (not shown) in the vicinity of the luminaire.

The luminaire housing 17 further holds the lensed reflector system of the invention. The lensed reflector system is generally denoted by the numeral 42 and lies within the housing generally behind and in close proximity to the fluorescent lamps 13, 14 and provides a reflector plane at the bottom of the housing from which source light can be reflected over a wide range of angles. The lensed reflector system ("kicker reflector") includes a bottom reflector substrate 43 suitably having a reflecting surface 44 and a front lens portion 45 having a prismatic surface such as shown in detail in FIGS. 3 and 3A, which optically cooperate to provide the unique reflection characteristics described above in the summary of the invention. In order to provide an even widespread distribution of light from the luminaire of FIGS. 1-2, the reflector substrate of the lensed reflector system is suitably a diffuse reflector to provide a diffuse component to the source light reflected off the system.

Secondary side reflector elements 47, 49, which are suitably specular reflectors, and which extend substantially vertically upward from the bottom of the housing cavity 40 to the housing top opening to approximately the maximum height of the lamp sockets 15, 16, are supported in their upright position by support bracket structures 50, 51. The secondary reflector side walls act to receive and redirect a portion of the light reflected from the kicker reflector as hereinafter described; they and their supporting structures also act to provide a light foil between the lamps 13, 14 and lens elements 31, 33 for substantially blocking direct transmission of primary source light to the lens elements. The light foil created by the vertically oriented reflector side walls force the brightness in the lens elements to be induced substantially entirely by the secondary source light reflected from the overhead ceiling.

With further reference to the FIGS. 1-2 embodiment, the thin lens material making up the front lens portion of the lensed reflector system is seen to overlay the planar reflector substrate to place the reflecting surface of the substrate into close proximity to and in nearly parallel planes with the light refracting surfaces of the lens. The lens is suitably a Fresnel lens fabricated of an acrylic plastic, however, where the lens material is positioned near a compact high intensity lamp which has a high heat output, a more heat resistant material should be used, suitably a plastic material sold under the commercial name, KAMAX, by the Rolm and Haas Company.

The lensed reflector system shown in FIGS. 1-3 is shown to have a lens material that includes a center portion consisting of two slightly outwardly inclined lens portions 55, 57, each having top prismatic surfaces 59, 61, and two opposed laterally extending edge portions 63, 65 having top prismatic surfaces 67, 69. The overall width of the lensed reflector system, as defined by its extending edge portions, is chosen so that the system covers substantially the entire width of the bottom of the housing cavity 40. It can be seen that the bottom of the housing cavity will generally define a reflector plane above which the source light will be reflected internally of the housing cavity by the lensed reflector system over a range of reflected angles which generally can range from perpendicular to the horizontal.

Both the prismatic surfaces 59, 61 on the center portion of the lensed reflector system and the outer prismatic surfaces 67, 69 act to control the distribution of reflected light from the reflector system by determining the reflection angle at which internal reflections in the lens cause the lens to dominate the reflection characteristics of the overall system. With a diffuser reflector substrate, the prismatic lens material causes the lensed reflector system to exhibit a high degree of specularity within specular beam angles on either side of the fluorescent lamps 13, 14, within a background of diffuse reflection outside these beam angles. In other words, an image of the source light would be seen if the kicker reflector were viewed at the specular beam angle but would not be seen at other viewing angles. In this manner, the lensed reflector system effectively "kicks" the distribution of light coming off the kicker reflector, concentrating a greater portion of this reflected light to the side of the housing cavity 40.

The specular beam angle exhibited by the lensed reflector system 42 is suitably chosen so that the specular beam of light is directed to the secondary side reflectors 47, 49. The general light spreading characteristics of this optical system are generally illustrated in FIG. 1 by light rays denoted by the letter "A" which emerge from the top and bottom halves of the compact fluorescent lamp 13, strike the center and edge portions of the right side of the lensed reflector system, and then reflect back toward the secondary side reflector 49, from whence the light rays are reflected laterally across the top of the luminaire through the luminaire's top opening 41.

The kicking function of the lensed reflector system 42 is further illustrated in FIG. 4 by means of light distribution patterns on a polar graph on which a lensed reflector system 71 and secondary side reflector element 73 are pictorially represented. The light distribution curve 75 shown in dash lines generally represents a diffuse light distribution pattern characterizing the reflection of light from a non-specular, light diffusing reflector surface without the lensed reflector system of the invention. The narrower and more directional light distribution pattern 76 generally illustrates how the more diffuse light distribution 75 can be kicked by the lensed reflector system of the invention to concentrate portions of the overall reflected light toward the secondary reflector element. It will be understood that the graph of FIG. 4 and the light distribution patterns illustrated thereon are representative of the concept of the invention only and are not intended to represent an actual light distribution patterns from the lensed reflector system of the FIGS. 1-3 luminaire, or any other luminaire.

Figure 5:
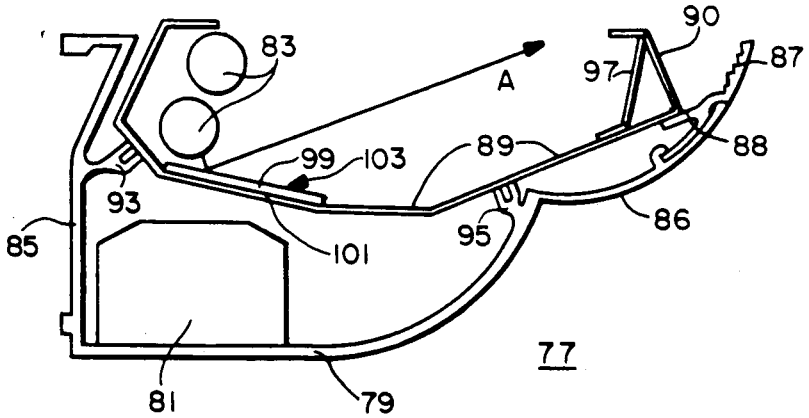
FIG. 5 is a cross-sectional view of a wall mounted lensed indirect luminaire showing the use of a kicker reflector in accordance with the invention.

FIG. 5 illustrates an alternative embodiment of the invention wherein the luminaire is an asymmetrical wall mounted luminaire generally denoted by the numeral 77, instead of a symmetrical luminaire as shown in FIGS. 1 and 2. In the FIG. 5 embodiment, the luminaire is comprised of an asymmetrical opaque housing 79, ballast 81 positioned at the back of the housing, and high intensity compact fluorescent lamp 83. A housing back wall 85 extends upward behind the lamps to serve as a mounting surface for mounting the luminaire against a vertical wall surface (not shown). The housing, which extends away from this back wall outward and then upward about the light source in a double convoluted shape, additionally provides an opaque side wall 85, the end of which receives, by means of a snap-in engagement, elongated lens element 87. It can be seen that the lens element 87 generally provides an extension of the shape of the housing side wall 86 up to approximately the height of the compact fluorescent lamps.

A shaped reflector 89 for reflecting light up through the top opening 91 of the FIG. 5 luminaire, and which is mounted within the housing 79 on reflector mounts 93, 95, extends generally from behind the fluorescent lamps forwardly to the base 88 of the lensed element 87. The extreme end 90 of the shaped reflector is bent upward to provide a light foil for the lens element 87, that is, a means for preventing the light from the compact fluorescent lamp 83 from being directly received by the lens element. In this manner, brightness in the lens element 87, like the embodiment of FIGS. 1-3, is induced substantially entirely by secondary source light reflected back from the vertical wall surface against which the luminaire is mounted and from illuminated overhead ceiling surfaces. An additional back reflector strip 97 positioned in opposition to the lamp sockets (not shown) for the compact fluorescent lamps of the luminaire is secured inwardly of the extended end 90 of the shaped reflector at an angle which increases the amount of light reflected back against the vertical wall surface adjacent the luminaire. This back reflector strip will act to illuminate dark areas on adjacent wall surfaces created by the presence of the lamp sockets.

Figure 6:
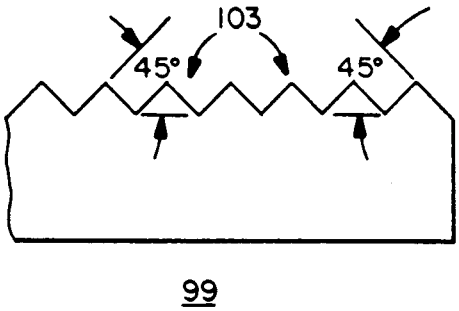
FIG. 6 is an expanded, partial side elevational view of the front lens portion of the kicker reflector shown in FIG. 5 illustrating the prismatic design thereof.

The FIG. 5 luminaire has a lens material 99 overlying a reflector substrate 101, formed by a portion of the luminaire's shaped reflector 89, so as to provide a lensed reflector system in accordance with the invention immediately below and in front of the fluorescent lamp 83. As generally represented by the light ray denoted by the numeral "A" in FIG. 5, the prismatic configuration of the lens material 99 and the inclination of the substrate reflector 101 is chosen to provide a beam of specular reflectance at an angle which concentrates a portion of the reflected light through the top opening 91 of the housing cavity and also at the secondary reflector element 97. In this manner, the luminaire's light distribution pattern can be kicked as discussed above to provide greater control over the luminaire's light distribution and to provide relatively even illumination on the wall surfaces adjacent the luminaire. As shown in FIG. 6, the top surfaces 103 of the lens material 99 of the lensed reflector system is a prismatic surface which suitably can have light concentrating prism angles as shown in FIG. 6.

It can therefore be seen that the present invention provides a lensed reflector system which has the characteristics of both a specular reflector and a non-specular reflector within the same optical element, or which can otherwise provide specular reflectance at a desired specular beam angle as determined by the lens portion of the reflector system. Using the lensed reflector system of the invention, light distribution pattern of a luminaire can effectively be made more direct or kicked at the reflector plane in close proximity to the light source.

The invention provides a means for enhancing and obtaining greater control over the light distribution pattern of a compact luminaire using compact, high intensity fluorescent light sources and having light sources and optical control elements separated by relatively small distances.

Although the invention has been described in considerable detail in the foregoing specification, it will be understood that the invention is not intended to be limited to such detail, except as necessitated by the appended claims.

What I claim is:

1. A luminaire comprising a housing, a source of light within said housing, and a lensed reflector system disposed in a reflector plane within said housing, said lensed reflector system being situated proximate said light source for reflecting source light therefrom at angles within a range of light reflection angles above said reflector plane, and being comprised of a front lens portion formed to produce specular reflection therefrom within at least one specular beam of reflected light within said range of light reflection angles, and a reflector substrate which governs the reflection characteristics of said lensed reflector system over the remaining reflection angles within said range of light reflection angles.

2. The luminaire of claim 1 wherein said reflector substrate has a substantially diffuse reflecting surface whereby said lensed reflector system exhibits substantially diffuse reflection characteristics at reflection angles within said range of light reflection angles other than at specular beam angles.

3. The luminaire of claim 1 wherein said reflector substrate has a substantially specular reflecting surface.

4. The luminaire of claim 1 further comprising a light redirecting element positioned in front of the plane of said lensed reflector system at an angular position relative thereto whereby said light redirecting element receives source light from said lensed reflector system at specular beam angles and redirects same from said housing in a desired light distribution pattern.

5. The luminaire of claim 4 wherein said light redirecting element is a secondary reflector element.

6. The luminaire of claim 1 wherein the front lens portion of said lensed reflector system is disposed to closely overlay said reflector substrate.

7. The luminaire of claim 1 wherein said front lens portion includes a Fresnel lens.

8. The luminaire of claim 1 wherein said light source includes at least one compact high intensity fluorescent lamp positioned in close proximity to said lensed reflector system.

9. A luminaire comprising a housing, a source of light within said housing, a lensed reflector system disposed in a reflector plane within said housing, said lensed reflector system being situated proximate said light source for reflecting source light therefrom at angles within a range of light reflection angles above said reflector plane, said lensed reflector system comprising a reflector substrate having a substantially diffuse reflecting surface and a front lens portion disposed to closely overlay said reflector substrate, said front lens portion having a refracting prismatic surface formed to produce specular reflection from said front lens portion within at least one specular beam of reflected light within said range of light reflection angles, and said reflector substrate providing said lensed reflector system with substantially diffuse reflection characteristics at reflection angles within said range of light reflection angles other than at specular beam angles.

10. The luminaire of claim 9 wherein the reflector substrate of said lensed reflector system is a white diffuse reflector and the front lens portion is a Fresnel lens.

11. The luminaire of claim 9 wherein at least a portion of said front lens portion is angled slightly in relation to said reflector substrate to achieve a desired specular beam reflection angle.

12. The luminaire of claim 9 wherein said luminaire is an indirect luminaire and said light source is positioned above said lensed reflector system in close proximity thereto.

13. The luminaire of claim 12 wherein said light source is symmetrically centered in front of said lensed reflector system and wherein said lensed reflector system produces a beam of specular reflection on either side of said light source.

14. The luminaire of claim 9 wherein said light source includes at least one compact high intensity fluorescent lamp.

15. The luminaire of claim 14 wherein said reflector substrate is comprised of a planar reflector strip lying behind said fluorescent lamp and laterally extending to either side thereof, and said front lens portion is comprised of a lens strip having lateral edge portions to either side of said fluorescent lamp and a central portion extending behind and in closer proximity to said fluorescent lamp, the central portion of said lens being angled slightly outwardly from said fluorescent lamp in relation to the lens' lateral edge portions.

16. The luminaire of claim 14 wherein said reflector substrate is comprised of a relatively narrow planar reflector strip lying behind said fluorescent lamp and laterally extending to one side thereof, and said lens material is a relatively narrow planar lens strip disposed to closely overlay said reflector strip.

17. A luminaire comprising a housing, a source of light within said housing comprised of at least one compact high intensity fluorescent lamp, and a lensed reflector system disposed in a reflector plane within said housing generally behind and in close proximity to said compact high intensity fluorescent lamp for reflecting source light therefrom at angles within a range of light reflection angles above said reflector plane, said lensed reflector system comprising a reflector substrate having a substantially diffuse reflecting surface and a Fresnel lens material closely overlaying said reflector substrate, and said lensed reflector system being situated behind said compact high intensity fluorescent lamp so as to produce specular reflection therefrom within at least one specular beam of reflected light within said range of light reflection angles and so as to exhibit substantially diffuse reflection characteristics at reflection angles within said range of light reflection angles other than at specular beam angles.

18. The luminaire of claim 17 wherein said reflector substrate is comprised of a white diffuse reflector.

19. The luminaire of claim 17 further comprising a light redirecting element positioned in front of the plane of said lensed reflector system at an angular position relative thereto whereby said light redirecting element receives source light from said lensed reflector system at specular beam angles and redirects same from said housing in a desired light distribution pattern.

20. The luminaire of claim 19 wherein said light redirecting element is a secondary reflector element.

21. A lensed reflector system for a luminaire for reflecting light from the luminaire's light source at angles within a range of light reflection angles, said lensed reflector system comprising a front lens portion including a Fresnel lens formed to produce specular reflection therefrom within at least one specular beam of reflected light within said range of light reflection angles, and a reflector substrate which governs the reflection characteristics of said lensed reflector system over the remaining reflection angles within said range of light reflection angles.

22. The lensed reflection system of claim 21 wherein said front lens portion includes a Fresnel lens.

23. A lensed reflector system for a luminaire for reflecting light from the luminaire's light source at angles within a range of light reflection angles, said light reflecting optical control element comprising a reflector substrate having a white diffuse reflector surface, and a Fresnel lens material disposed to closely overlay said reflector substrate.

24. A lensed reflector system for a luminaire for reflecting light from the luminaire's light source at angles within a range of light reflection angles, said lensed reflector system comprising a front lens formed to produce specular reflection therefrom within at least two specular beams of reflected light within said range of light reflection angles, and a reflector substrate which governs the reflection characteristics of said lensed reflector system over the remaining reflection angles within said range of light reflection angles.

25. The lensed reflector system of claim 24 wherein said front lens includes at least two lens portions inclined in different planes for producing a specular beam of reflected light from each of said lens portions when said lensed reflector system is situated proximate the light source of a luminaire.

26. The lensed reflector system of claim 25 wherein said two inclined lensed portions lie in intersecting planes.

27. The lensed reflector system of claim 26 wherein said intersecting inclined lensed portions from a central portion of the front lens, and said front lens further includes lateral edge portions extending from either side of said central portion.

28. The lensed reflector of claim 27 wherein said reflector substrate is a diffuse reflector.

29. The lensed reflector system of claim 28 wherein said reflector substrate is a flat reflector material underlying said front lens.

* * * * *